United States Patent [19]

Lancaster, III et al.

[11] 4,271,657

[45] Jun. 9, 1981

[54] AUTOMATIC WEB TYING APPARATUS

[75] Inventors: Patrick R. Lancaster, III, Anchorage; William G. Lancaster, Louisville, both of Ky.

[73] Assignee: Lantech Inc., Louisville, Ky.

[21] Appl. No.: 21,198

[22] Filed: Mar. 16, 1979

Related U.S. Application Data

[63] Continuation of Ser. No. 928,236, Jul. 26, 1978, Pat. No. 4,235,062, which is a continuation of Ser. No. 911,652, Jun. 1, 1978, Pat. No. 4,204,377, which is a continuation-in-part of Ser. No. 709,957, Jul. 30, 1976, Continuation of Ser. No. 478,523, Jun. 12, 1974, abandoned.

[51] Int. Cl.[3] ..... B65B 11/04

[52] U.S. Cl. ..... 53/399; 53/441; 53/138 R; 53/556; 53/587

[58] Field of Search ..... 53/399, 416, 441, 465, 53/138 R, 556, 587, 588, 210, 211; 100/13

[56] References Cited

U.S. PATENT DOCUMENTS

| | | | |
|---|---|---|---|
| 3,126,686 | 3/1964 | Kobylanski | 53/138 R X |
| 3,587,204 | 6/1971 | George | 53/138 A |
| 3,986,611 | 10/1976 | Dreher | 53/441 X |
| 4,077,179 | 3/1978 | Lancaster et al. | 53/556 X |
| 4,136,501 | 1/1979 | Connolly | 53/441 X |
| 4,152,879 | 5/1979 | Shulman | 53/587 X |

FOREIGN PATENT DOCUMENTS

| | | | |
|---|---|---|---|
| 2383074 | 10/1978 | France | 53/587 |

OTHER PUBLICATIONS

"The Digest"-Dec. 1977 by Infra-Pak.

*Primary Examiner*—John Sipos
*Attorney, Agent, or Firm*—Gipple & Hale

[57] ABSTRACT

An apparatus and process for automatically making a spiral wrapped unitary package having a ring type or tied closure. In the apparatus a series of loads, each containing a plurality of units are fed one load at a time onto a turntable adjacent a material dispenser with the leading edge of the material from the dispenser being formed into a rope-like configuration by a roper mechanism and held by a clamp mechanism mounted on the turntable. The material is opened to its full web width, stretched and is spirally wrapped around the load at which time it is again formed into another rope-like configuration by the roper mechanism, and is positioned adjacent the leading edge where it is mechanically joined to the leading edge of the material by a ring type or tied closure. The roped material is then released from the clamp mechanism mounted on the turntable and the material is allowed to return to its memory position. The clamp mechanism again clamps the leading edge for the next load and the material is severed from the wrapped load.

26 Claims, 16 Drawing Figures

80
120
130
70
98
86
142
92
140
112

130
110
92
98
70
134
133
94
96
92

AUTOMATIC WEB TYING APPARATUS

RELATED APPLICATION

This is a continuation-in-part of U.S. application Ser. No. 928,236 filed July 26, 1978, now U.S. Pat. No. 4,235,062 which is a continuation-in-part of U.S. application Ser. No. 911,652 filed June 1, 1978, now U.S. Pat. No. 4,204,377, which is a continuation-in-part of U.S. application Ser. No. 709,957 filed July 30, 1976 which is a continuation of U.S. application Ser. No. 478,523 filed June 12, 1974, now abandoned.

BACKGROUND OF THE INVENTION

The present invention generally relates to packaging and more particularly to a method and apparatus for making unitary packages which hold a plurality of components, each package containing a load wrapped in a web of stretched material.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking it to form a unitized package. The use of heat shrinkable film is described in U.S. Pat. Nos. 3,793,798; 3,626,654; 3,590,549 and 3,514,920. A discussion of this art is set forth in U.S. Pat. No. 3,867,806.

The present invention provides a simple, reliable and inexpensive method of unitizing multiple unit products into a single wrapped package with an overwrap material which cannot be effectively sealed.

When the present process and apparatus is compared with other apparatus and processes currently used to pack products in corrugated boxes and the cost of the corrugated boxes themselves, the invention shows an enormous cost savings. The invention has comparable costs with kraft wrap but it gives a much tighter and better unitized package than that possible with kraft wrap. In addition to these factors the invention can use a stretch netting material, stretch mesh material or a collapsed web of stretch film which provides product visibility not possible with kraft or corrugated wrapping plus the desirable feature of letting the load "breathe". This feature is especially desirable when live produce is packaged and shipped. Furthermore, the present inventive system offers packaging speed, reliability of package seal and energy savings in that less energy is required to package the product.

A basic problem with shrink and non-cling stretch film packaging is that the primary strength and reliability of the package is determined by the consistent quality of the seal. These seals depend on a careful maintenance of the sealing jaw and are never as strong as the film itself. The time that it takes to make the seals is a limiting factor on the possible speeds of most shrink systems with the additional problem that some stretchable materials, as for example stretch netting, cannot be heat sealed.

The present invention does not require a structural seal and therefore can use any type of stretchable material. The invention is designed to function with a stretchable plastic netting material such as that known in the trade as "stretch net" manufactured by Bemis Bag but can be used with other stretchable film webs such as P.V.C. or low or high density polyethylene. In the present invention the apparatus utilizes a mechanical closure device to join a rope formed from the leading edge of the material to a rope formed from the trailing edge, while severing the load from the leading edge of the subsequent load wrap.

The use of spiral wrapping machinery is well known in the art. One such apparatus is shown by U.S. Pat. No. 3,863,425 in which film is guided from a roll and wrapped around a cylindrical load in a spiral configuration. A carriage drives the film roll adjacent the surface of the load to deposit an overlapping spiral wrap around the load and returns in the opposite direction to deposit another spiral overwrap around the load. Other spiral wrapping apparatus are described by U.S. Pat. Nos. 3,857,486; 3,788,199; 3,549,077; 3,412,524; 3,191,289 and 2,716,315. The previously indicated patents rely on heat shrink material, adhesives, a heat seal or the tacky nature of the film to hold the outer layer of wrap in a fixed position.

The turntable clamping assembly described in this specification is disclosed in U.S. Pat. No. 4,077,179. Various patents have described the use of mechanisms for wrapping materials. In U.S. Pat. No. 3,003,297 a complex cutting and holding mechanism is used to place tape on a box and cut it off with the process being repeated for each box. The use of adhesive on the tape to bond it to the package is an integral part of the function of this concept. Without this adhesion it would not work either in single, multiple or spiral configurations. The unique design and function of the tying, clamping and cutting mechanisms in the present invention does not require a bonding or heating of the film in order for the system to operate.

U.S. Pat. No. 2,088,133 discloses a reverse wrapping wire tying machine. In the reference a gripper mechanism holds a band in position with respect to the load to be wrapped and a rotatable ring drive rotates the band around the load until the band has completed more than one wrap of the load and passes over the body of the gripper mechanism.

A separator slide is used to separate the leading edge of the band from the underlying band and a second gripper mechanism attaches to the separated band. A heat sealing mechanism welds the wrapped layer band to the band underneath it and a cutting mechanism severs the leading edge of the band held by the second gripper mechanism which then becomes the trailing edge of the succeeding wrap. When the band is severed the ring drive mechanism is rotated in a reverse direction for the following load with the various gripping and cutting mechanisms functioning in the same manner.

Additional references of interest which are pertinent to rotatable drives for wrapping packages are disclosed in U.S. Pat. Nos.: 3,820,451; 3,331,312; 3,324,789; 3,309,839; 3,207,060; 2,743,562; 2,630,751; 2,330,629; 2,054,603 and 2,124,770.

Other applications in packaging are shown by U.S. Pat. Nos. 3,514,920 and 3,793,798 in which heat shrink film is wrapped around a pallet supporting a plurality of cartons. A similar full web apparatus using a tensioned cling film is shown by U.S. Pat. No. 3,986,611 while another apparatus using a tacky P.V.C. film is disclosed in U.S. Pat. No. 3,795,086.

The mechanical closure device described in the present specification is a standard "hog ring" type unit such as models Type I and Type C manufactured by ATRO.

U.S. Pat. No. 2,124,770 discloses a wrapping apparatus with a clip mechanism for fastening adjacent rope strands. The bundle wrapping machine is automatically operable to wrap a length of rope, or the like, once about a package or bundle, to draw it taut with its ends in overlapped relation, to apply and cinch one or two metal clips or seals about the overlapped ends to join them permanently together and finally to cut the rope at the outside of the seals thereby to release the bundle. The machine uses paired grippers, one of which is actuated to grip and hold the initial end of the rope during the wrapping operation, while the other is actuated so that it will engage and then grip and hold that portion of the rope that is brought adjacent to the initial end for the clip applying operation. The rope grippers comprise horizontally disposed plungers which extend outwardly to oppose the inward gripping pressure of gripper pressure hooks. As the hooks pull inwardly they pull the rope against a sharpened cutting surface of a cutter plate mounted in the end of the top frame. After the clips are applied the rope is cut off at the outside of the clips to free the bundle with one gripper retaining its hold on the end of the rope leading from the supply, preparatory to a following wrapping operation which will take place in a reverse direction.

The present invention uses stretchable plastic material in its preferred embodiment since the mechanical stretching of the material utilizes its strength better than heat shrink wrap and can be used on loads where breathing is necessary or no heat can be applied to the product. The elasticity of the material or film holds the products under more tension than either shrink wrap or kraft wrap particularly with products which settle or relax when packaged.

Various apparatus and processes have been developed by the named inventors of the invention to utilize stretch material in package wrapping. Such apparatus and processes are disclosed in U.S. Pat. Nos. 3,867,806; 4,050,220; 4,077,179 and 4,079,565.

Additional benefits occur in the present invention over the prior art in that no changeover is required in handling random size units of a variety of materials as the apparatus is constructed to handle such random size units. Furthermore, the apparatus provides a substantially continuous wrapping operation so that loads can be wrapped at any desired speed and for any time period. A significant economic factor is also present in the present invention as the power requirements are significantly less than those of shrink systems since there is no heat tunnel required and greater speeds of operation are possible because of the elimination of the conventional heat seal which is used in non-cling wrapping. Furthermore, a wider number of products can be handled by the present invention because of the elimination of the heat seal requirement. It should also be noted that adhesives do not work efficiently on netting material due to the lack of gripping surface. Because of the simplicity of the construction of the invention there is a greater stability in the inventive wrapping apparatus with less maintenance being required to maintain the apparatus resulting in a corresponding reduction in breakdown time. Another desired characteristic resulting from the apparatus construction is that the invention does not take up much floor space.

SUMMARY OF THE INVENTION

The present invention generally comprises a novel apparatus and process for automatically making spirally wrapped unitary packages having an overwrap which is not heat sealed. In the apparatus a series of loads, each containing a plurality of units are singularly fed onto a turntable adjacent the spiral wrapping apparatus.

The leading edge of the material from the dispenser is held by a clamp mechanism of the turntable and the turntable is rotated to wrap the load with material which is stretched as it is wrapped around the load. The material is spirally wrapped around the load and is then formed into a rope-like configuration which is carried adjacent the clamped leading edge where it is tied to the clamped leading edge. The clamp mechanism releases the material which is carried toward the wrapped load by the memory of the material seeking its original state. The clamp mechanism clamps the material for the next operation, at which time a cutting mechanism severs the material between the clamp and the load and the wrapped load is transported off the turntable.

The above-mentioned purpose and operations of the invention are more readily apparent when read in conjunction with the following description of the drawings and the detailed description of the preferred embodiment of the present invention.

DETAILED DESCRIPTION OF THE DRAWINGS

Figure 1:
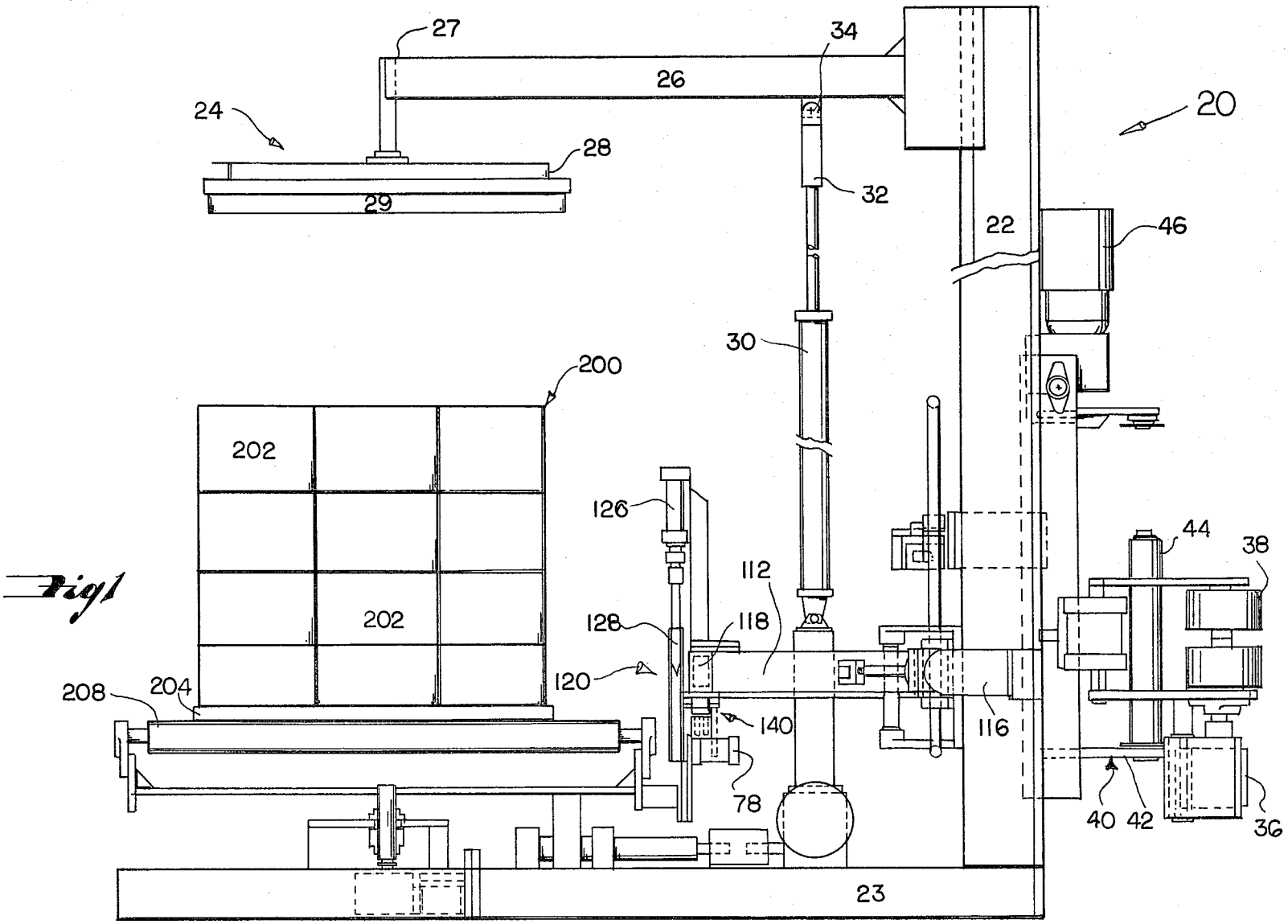
FIG. 1 is a side elevational view of the inventive load wrapping and tying apparatus.
Figure 2:
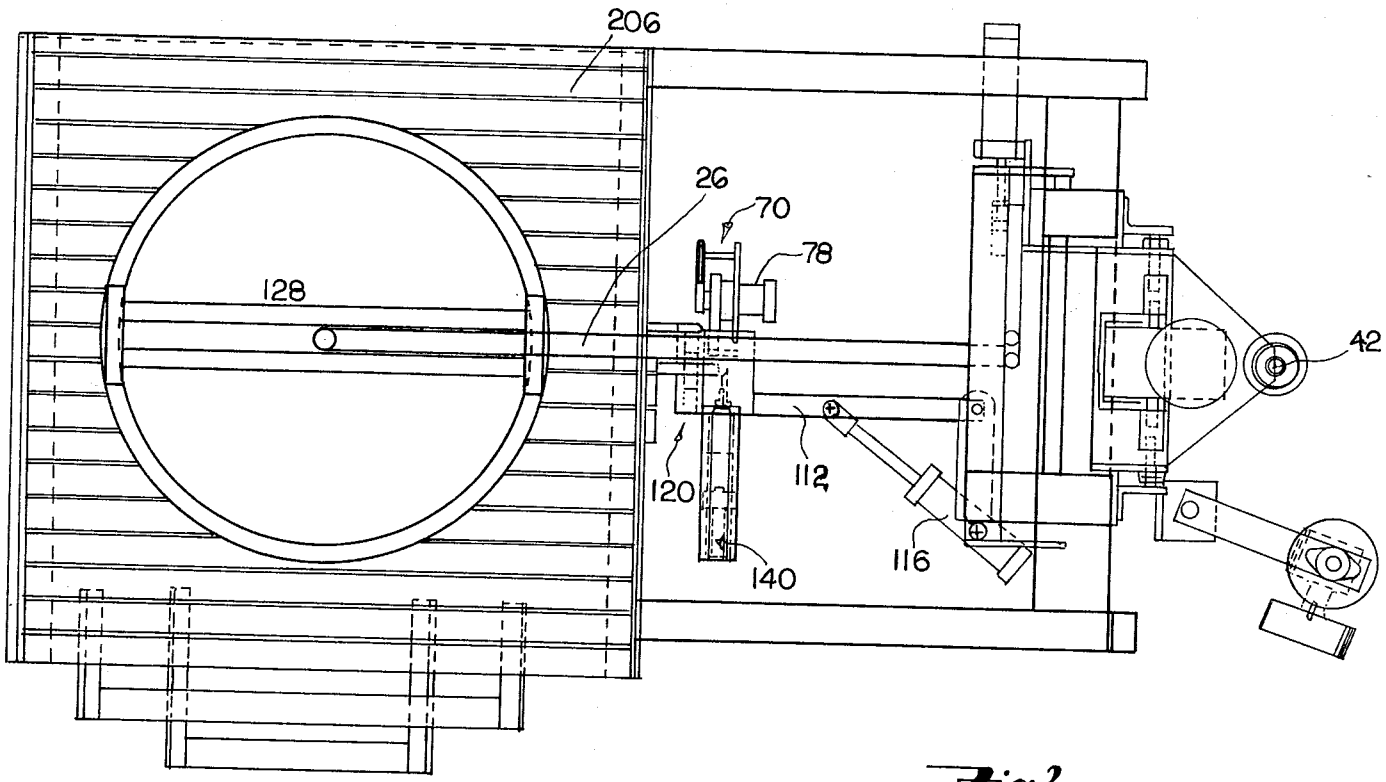
FIG. 2 is a top plan view of the apparatus shown in FIG. 1.
Figure 3:
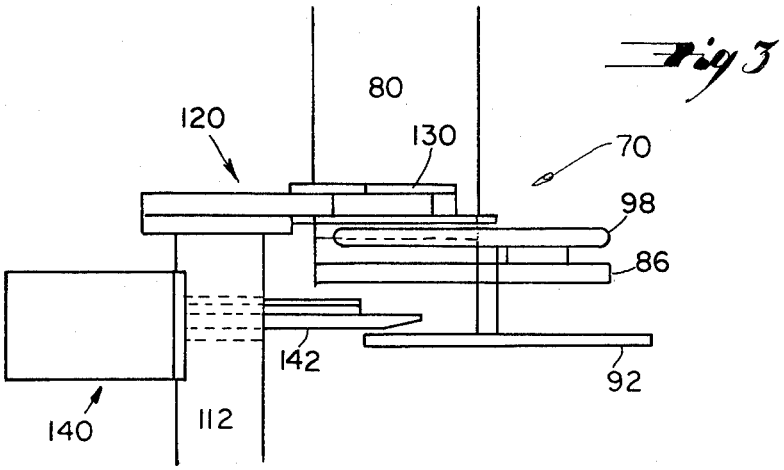
FIG. 3 is an enlarged partial top plan view partially in section of the clamping assembly and tying assembly of the inventive apparatus.
Figure 4:
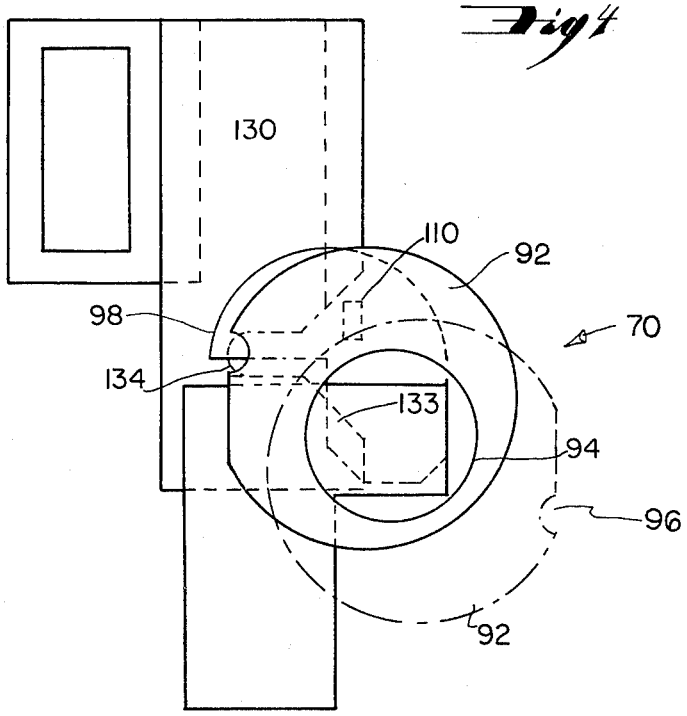
FIG. 4 is a side elevational view of the clamping assembly shown in FIG. 3 showing the position of the assembly when rotated in phantom.
Figure 5:
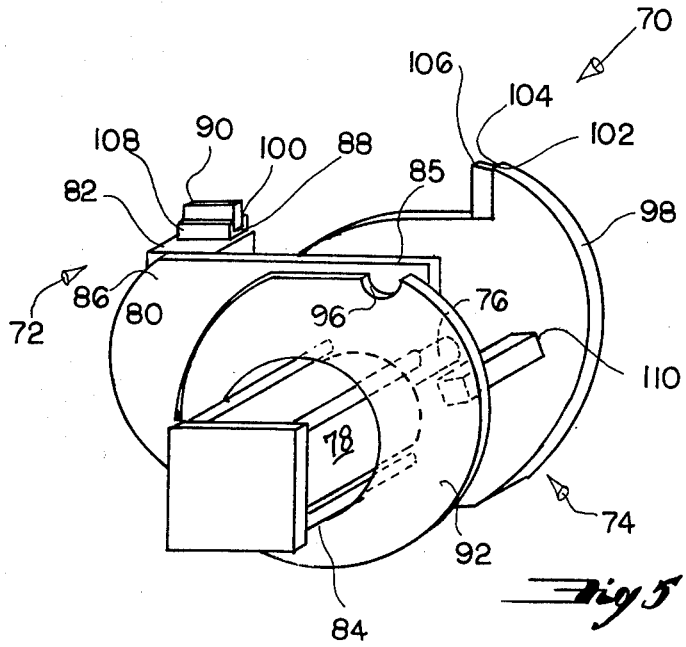
FIG. 5 is an enlarged isolated perspective view of the clamping assembly of the apparatus in an open position.
Figure 9A:
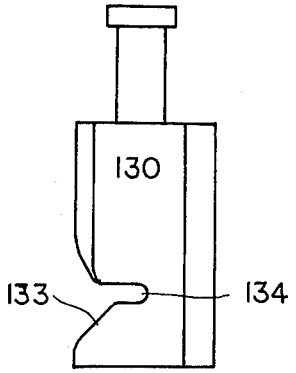
FIG. 9A is a side elevational view of the cutter mechanism housing.
Figure 6:
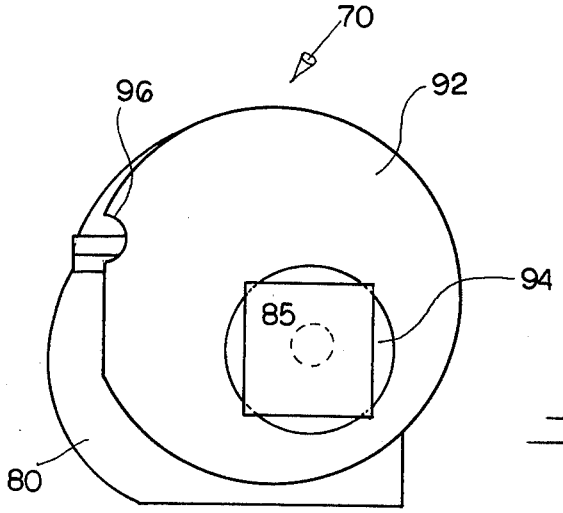
FIG. 6 is a side elevational view of the clamping assembly of the apparatus in a closed position.

The spiral wrapping and tying apparatus 20 is most clearly shown in FIGS. 1 through 9A with operation of the apparatus and its respective component parts being schematically shown in FIGS. 10 through 15.

The wrapping and tying apparatus 20 comprises an upright frame 22 sitting on a base 23. A platen assembly 24 is mounted on the frame 22 for movement along the frame. The platen assembly comprises a support structure 26 moveably mounted to the frame and the platen 28 moveably mounted to the support structure. A pneumatic cylinder 30 is mounted to the base 23 with its piston rod 32 mounted to the platen support structure 26 by means of a bracket and pin assembly 34. Thus the platen can be raised or lowered manually by an operator or in automatic sequence during the wrapping stages of the load. The platen has a flexible lower surface 29 which is adapted to be placed on top of a load 200, comprising a plurality of unitary members 202 stacked on a pallet 204. The lower surface 29 of the platen is lowered onto the top of the load 200 after the load is carried by a power conveyor 206 onto turntable 208.

When the turntable 208 is rotated the platen rotates within a journal 27 of the platen assembly holding the units in position on the load as a spiral material wrap is stretched wrapped around the load. The platen provides a force on the units 202 to prevent the units from being displaced or pulled from the load as the stretch netting material is wrapped around the load.

A film roll support or carriage 40 is moveably mounted on the frame 22. The film roll carriage includes a platform 42 and a film roll mandrel or vertical holding member 44 mounted on the platform 42. The mandrel 44 holds a roll of film of either a solid web material or of a netting material. The film roll carriage can be mounted in guides or tracks in the frame and is preferably driven by a rack and pinion drive although chain, screw or other known drives could be readily adapted to the invention. A drive motor 46 is mounted to the frame 22 and provides driving force needed to move the carriage. The film roll is restricted by the action of a magnetic particle brake 36 which subjects the film material to a braking force causing it to stretch as it is wrapped around the load. The restrictive force is preferably applied by utilizing a roller 38 as shown in FIG. 1 to engage the outside of the film roll and apply a constant force on the film roll uniformly stretching the film as it leaves the roll.

Figure 7:
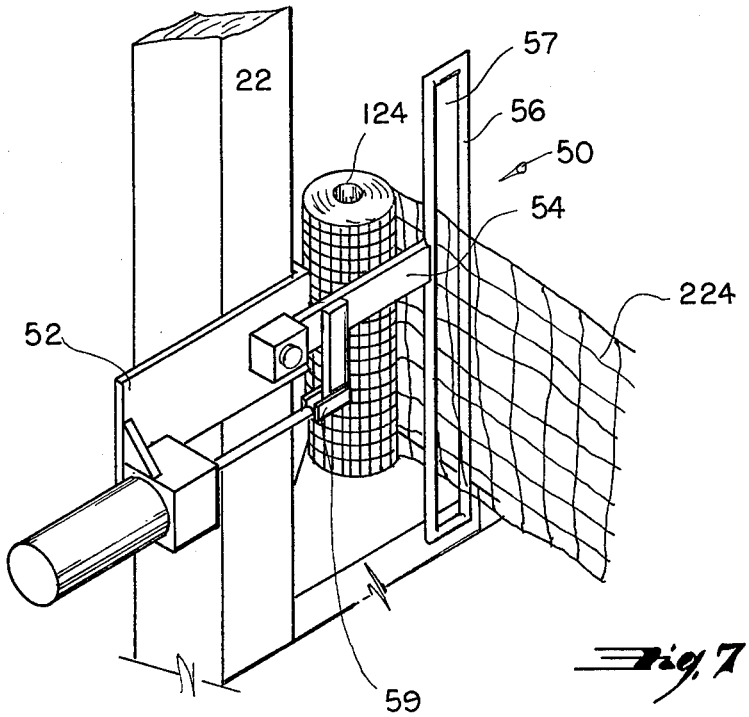
FIG. 7 is a partial perspective view of the web width changing mechanism of the apparatus when the web is in a full width open position.
Figure 8:
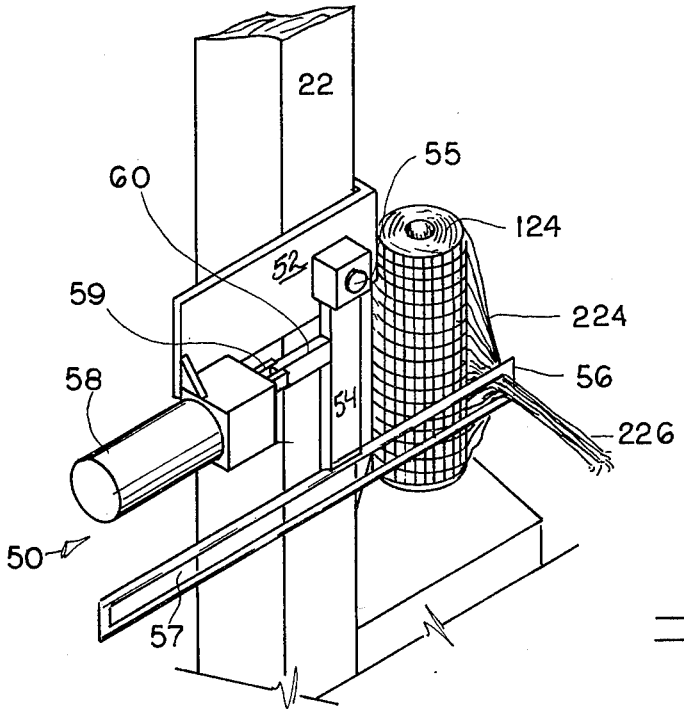
FIG. 8 is a partial perspective view of the web width changing mechanism when the mechanism is rotated to collapse the web into a rope.
Figure 9:
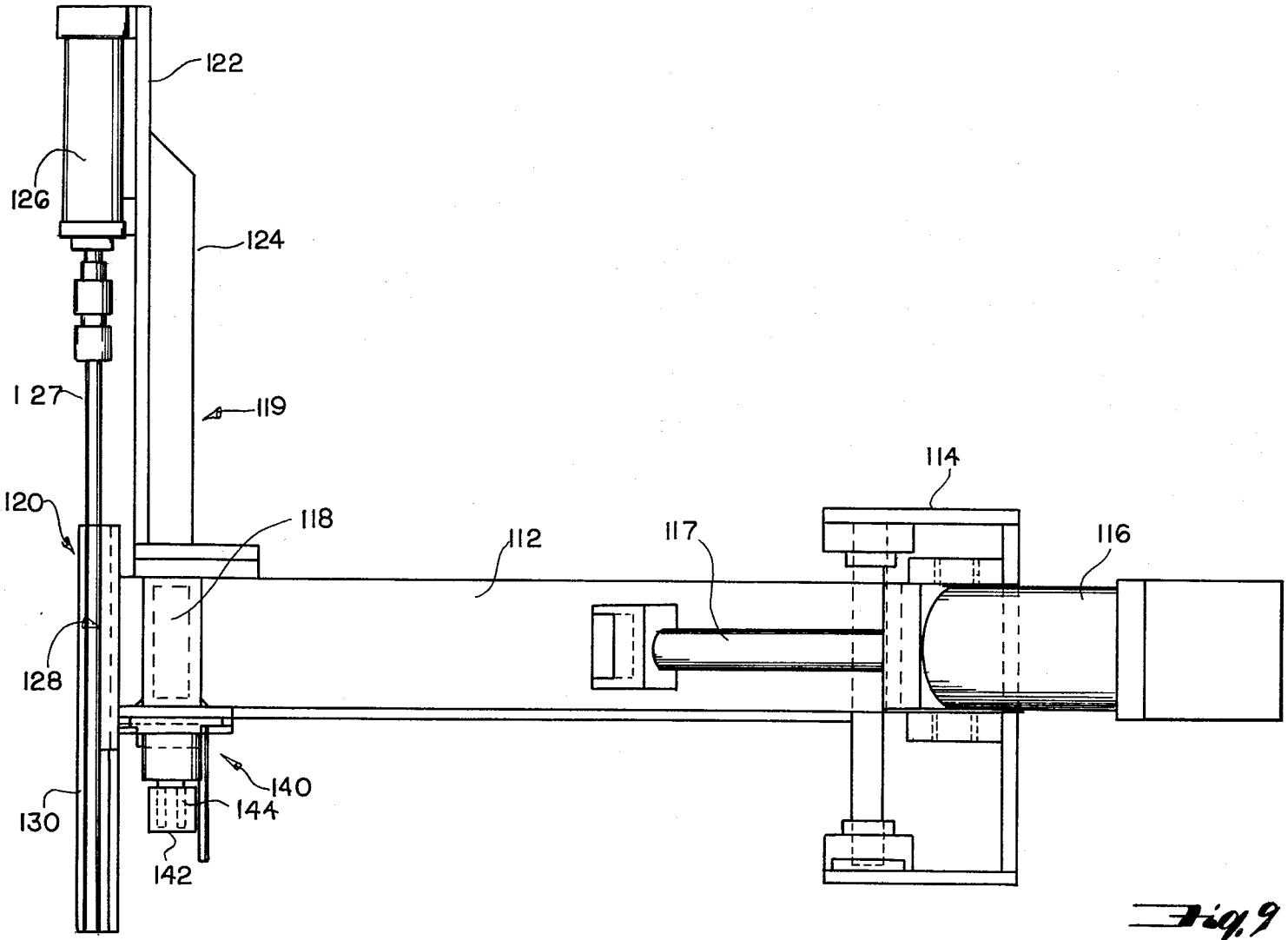
FIG. 9 is an enlarged side elevational view partially in cross-section of the cutter mechanism of the apparatus and the tying assembly of the apparatus.

It should be noted that film, film material and netting are used interchangeably throughout the specification. The netting 224 as it comes off the netting roll 124 is stretched by the brake 36 and passed through a roper mechanism 50. The roper mechanism which is best shown in FIGS. 7 and 8 comprises a support plate 52 secured to the frame 22 and a rotatable support bar 54 having one end rotatably mounted to the support plate, the other end being secured to the web reduction member 56.

The web reduction member 56 comprises a rectangular shaped bar which defines a rectangular aperture 57. The length of the rectangular aperture is greater than the width of the web of the material used for wrapping the load and the width of the rectangular aperture is greater than the thickness of the web and preferably is the thickness that the web is desired to be bunched or roped so that when member 56 is rotated, web material 224 is roped or convoluted 226 into a diameter substantially equal to or less than the width of aperture 57 as is best shown in FIG. 8.

A pneumatic activated cylinder 58 is secured to the support plate 52 or the frame and has an end 59 of its piston rod rotatably connected to drive bar 60 which is in turn secured to the rotatable support bar 54. The cylinder 58 can be energized by known fluid circuitry to move the rotatable support bar, so that it rotates around pivot point 55 carrying the web reduction member 56 upward or downward in an approximately 90° arc, causing the material web to be formed into a rope configuration 226 when the rectangular member is parallel to the ground or allowing free flow of the open web through the web reduction member 56 when the web reduction member is positioned substantially perpendicular to the ground.

The material web when roped, passes through a clamping assembly 70 mounted to the edge of the turntable. The clamping assembly 70 is best shown in FIGS. 3 through 6.

The clamp assembly 70 comprises a stationary arm mechanism 72 and a rotatable clamp mechanism 74 mounted to a shaft 76 which is rotated by a rotary pneumatic cylinder 78.

The stationary arm mechanism 72 comprises a support block 80 mounted to turntable 208, a seat support 82 secured to the support block 80 and a cylinder support subassembly 84 secured to the support block. The support block has its rear portion 85 secured to the pneumatic cylinder and its forward portion 86 secured to the stationary seat support 82. The seat support 82 has a "U" shaped seat 88 with a resilient friction member 90 made of rubber or other suitable resilient material secured in the seat and extending above the legs 100 and 108 of the "U" shaped seat 82 for engagement with clamp arm 98 of the rotary clamp mechanism 74. The rotary clamp mechanism 74 comprises a material guide member 92 of an eccentric shape having a circular aperture 94 of suitable diameter surrounding the pneumatic cylinder 78 so that the guide member 92 can freely rotate around the pneumatic cylinder. A curved surface notch 96 is cut inward from the exterior edge of the material guide member 92 a suitable distance which will allow the notch to receive and guide the roped material during the tying and severing operation of the apparatus.

The clamp arm 98 is secured to a spacer bar 110 which is secured in turn to the guide member 92. The clamp arm 98 has a cut away segment 102 which approximates a curved "L" shaped surface forming the contact surface for engagement with the resilient friction member 90. The segment 102 "L" shaped cross sectional configuration has a planar surface 104 adapted to engage the resilient friction member 90 to hold the roped material therebetween. The outwardly extending leg 106 of the "L" is adapted to be positioned adjacent the leg 108 of the seat 88 to engage the stretched material at the smallest angle of extension from the wrapped package.

A cutting mechanism 120 and tying mechanism 140 are secured to a moveable arm 112 which moves the mechanisms into the path of the material for the severing and tying steps. The arm 112 is rotatably mounted on support structure 114 and is driven by pneumatic cylinder 116 secured to the frame 122. Extension of the piston arm 117 of cylinder 116 drives the arm and the associated cutting and tying mechanism into the material path so that the mechanisms can perform their desired functions. Secured to the traversing arm 112 are a perpendicularly extending arm 118 which holds the tying mechanism 140 and a support structure 119 which is mounted to the top of the arm and supports the cutting mechanism 120. The cutting mechanism 120 comprises an upright support plate 122 and traverse brace 124 secured to the support plate and a piston 126 which is secured to the upright support plate 122. A piston arm 127 extends from the piston, the distal end of which is secured to a cutting blade 128. The cutting blade 128 is reciprocally positioned in a guillotine sheath or housing 130, which is secured to the end of traversing arm 112. The guillotine sheath 130 comprises a plate structure having an inwardly inclined notch 133 cut into one side adapted to receive the rope material and direct it into a center of the notch 134. The rope material when held in cutting notch 134 is severed by reciprocating action of the cutting blade 128 striking the rope material and cutting through the rope material.

A standard hog ringer device 142 such as that made by ATRO Company, types I and C is secured to the lower part of arm 119. A magazine 144 extends perpendicularly from the mechanism to feed staples or hog rings into the mechanism. In operation of such a standard hog ringer the shaped nose of the hog ring engages the materials to be tied together and a ring or staple is driven around the material held in the nose of the ring and fastened around materials by bending the ring or staple around the items to be tied. Thus the two roped web layers which have been placed side by side are fastened together through the action of the hog ring passing a staple around both of the ropes and fastening or tying them together through the contraction of the staple or bending of the staple or ring around materials.

Figure 10:
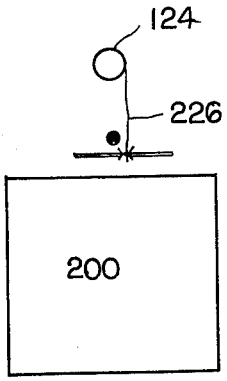
FIG. 10 is a schematic plan view of the material roped and held in the clamping assembly before wrapping of the load.
Figure 13:
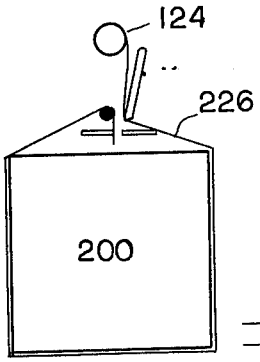
FIG. 13 is a sequential schematic plan view of the apparatus of FIG. 12 showing the gathering cutter housing moved in to overlay the roped web on the leading edge of the roped web.
Figure 11:
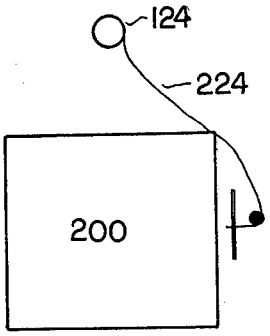
FIG. 11 is a sequential schematic plan view of the load shown in FIG. 10 with the turntable rotated approximately one quarter turn.
Figure 14:
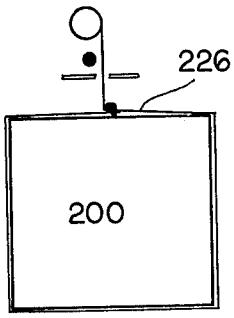
FIG. 14 is a sequential schematic plan view of the apparatus in FIG. 13 in which the clamps are opened allowing the tied rope webs to move to a material memory position between the load and the cutting mechanism.
Figure 12:
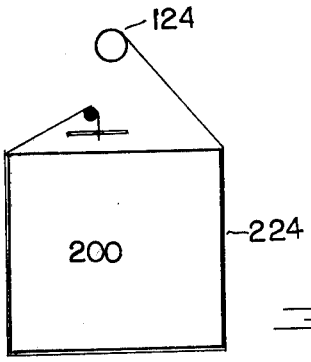
FIG. 12 is a sequential schematic plan view of the apparatus shown in FIG. 11 as the roll carriage starts up the load and the web is open to full width.
Figure 15:
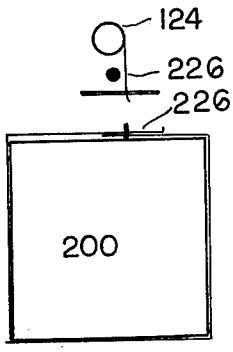
FIG. 15 is a sequential schematic plan view of the apparatus shown in continuance from FIG. 14, in which the trailing rope web is reclamped and the tied portion has been severed so that the wrapped load can be carried off of the turntable and a new load carried on the turntable to be wrapped.

The operation of the apparatus is schematically shown in sketches 10 through 14. In FIG. 10 the film is shown as roped, (See FIG. 8) as the rectangular web mechanism has been rotated in an arc of 90° so that the web is bunched up into a rope which is then held in the clamp mechanism 70. At this time the voltage on the material brake is 0 so that little or no tension is placed on the material web. The turntable 208 with the associated clamp mechanism rotates approximately a quarter of a turn with the brake off of the material roll for approximately one second. During this cycle the roll carriage delays movement for approximately one second and the roper mechanism stays down into the roping configuration for approximately one second. After this time sequence has passed the roll carriage starts travelling up the frame carrying the web of material with it and the brake comes on to a hundred percent of the tension setting, stretching the material as it is pulled off of the material roll by the rotation of the load. At the same time the roper mechanism is arced upward 90° through the action of the pneumatic cylinder, so that the material web is opened and at its full web width. The apparatus then wraps at least one up and down cycle on the load and at the bottom of the bottom cycle counts out a number of rotations around the load through the use of a standard bottom counter, which may be of known electronic circuitry, mechanical gauges based on the rotation of the turntable or any other suitable mechanism. Approximately one half revolution before the turntable comes into the home position the brake setting is reduced to fifty percent of the original full tension setting and the roper mechanism is rotated downward bunching or gathering the material web into a roped condition. The turntable is stopped in the home position at which time the brake is reduced to thirty percent of its original full tension setting and the gathering arm 112 is driven towards the clamp mechanism to overlay the trailing rope section on the leading end of the rope section at which time the tying mechanism 140 is inserted between the clamp sections to ring the two rope sections together. Upon tying the clamp is opened and the roper mechanism is raised to provide a length of slack allowing the tied ringed rope sections to move to the original memory position of the material somewhere between the load and the cutting device. The clamp is then closed clamping the trailing edge roped section and the roped section is cut on the load side of the clamp mechanism by a double action cutter, so that either netting or film or other material coming from the material roll is completely severed. The gathering arm 112 is then rotated back to its original position and the wrapped load is carried away from the turntable by power conveyors and a new unwrapped load is positioned on the turntable to start the wrapping operation.

While the sequence of operation of the invention is shown with the web in a roped position or open position it will be appreciated that by using a wider width roper mechanism that the material web width will be partially closed. Thus the web could be partially closed as it is wrapped around the load or partially closed and opened depending upon the web material used and the nature of the load being wrapped. The partially closed web can be roped by engaging the partially closed web with another member to further close the web into a roped configuration.

It should be noted that the steps of the wrapping process can be interchangable in order without departing from the scope of the invention. Furthermore, these steps can be interchanged and are equivalent.

In the foregoing description the invention has been described with reference to a particular preferred embodiment although it is to be understood that the specific details shown are merely illustrative and that the invention may be carried out in other ways without departing from the true spirit and scope of the following claims. What is claimed is:

1. A process for spirally wrapping a web of stretchable material around a load comprising a plurality of units to form a unitary packaged load comprising:

a. placing a roll of stretchable material on a dispenser;

b. withdrawing a leading end of said web of material from said roll and forming said leading end into a rope-like configuration having a width less than the width of the original web;

c. holding the leading rope-like end of said stretchable material adjacent a load comprising a plurality of units;

d. withdrawing said stretchable material from said roll;

opening the web of material from its rope-like configuration as it is drawn from said roll to assume an open web configuration while causing relative movement between said roll and said load;

f. stretching said material as it is dispensed from said roll to said load;

g. moving said material in a direction along the axis of the load to form a plurality of stretched wraps of material on said load;

h. reversing the direction of said movement of said material to provide a plurality of second stretched wraps of material over said first plurality of stretched wraps of material on said load;

i. engaging the open web with a roper mechanism to form the open web into a second rope-like configuration;

j. transporting the second rope-like configuration with a mechanism to a position adjacent the first rope-like configuration;

k. fastening said first rope-like configuration to said second rope-like configuration; and l. severing said second rope-like configuration from said roll of stretchable material.

2. A process as claimed in claim 1 wherein said material web in its rope-like configuration has a width less than 20% of its original web width.

3. A process of making a unitary package from a load comprising a plurality of units placed on a rotatable turntable by using a stretchable material which is wrapped around the load, comprising the steps of:

a. forming the leading end of a web of stretchable material taken from a dispensing means into a rope-like configured section having a width less than the width of the original web;

b. holding the roped web end in a clamp mounted to said turntable;

c. applying tension to the web of stretchable material so that the web of material is stretched;

d. rotating the load to apply the stretched web material to the load;

e. allowing the material web to resume its full web width;

f. moving the dispensing means reciprocally direction along the surface of the rotating load to form a plural spiral wrap;

g. forming said stretched full web of material into a second rope-like configured section with a roper mechanism adjacent said initial rope-like configured section;

h. fastening said first and second rope-like web sections together with a material tie;

i. releasing the roped web end from the clamp allowing movement of the fastened web sections toward the load;

j. clamping said second rope-like section in said turntable clamp; and k. severing said rope-like section between its clamped area and the load.

4. The process of claim 3 wherein said stretchable material is a plastic netting.

5. The process of claim 3 wherein said stretchable material is a plastic film material.

6. The process of claim 5 wherein said plastic film is polyethylene.

7. The process of claim 5 wherein said film is polyvinylchloride.

8. The process of claim 5 wherein said film material is high density polyethylene.

9. The process of claim 3 including the step of reducing the tension on the roll of stretchable material to a lesser tension than the previous tension at the end of the wrap cycle.

10. A process of making a spiral wrapped unitary package from a load comprising a plurality of units placed on a rotatable turntable comprising:

a. removing a leading end of a web of a roll of stretchable material from a dispensing means and reducing said web width to form it into a rope-like configuration;

b. holding said roped web in a clamp mounted to said turntable;

c. causing relative movement between said roll and said load so that stretched material is wrapped around said load;

d. applying tension to the stretchable material so that the material is stretched as it is transported to the load;

e. allowing the web of material to be wrapped on said load in a stretched open web condition while moving said roll of material along the axis of the load to form a spiral wrap over the surface of the load;

f. wrapping the stretched full web width material while moving said roll in a reverse direction over the surface of the rotating load to form a second spiral wrap over the surface of the load;

g. reducing said material web to form it into a second rope-like configuration;

h. carrying said second rope-like configuration with a moveable mechanism to a position adjacent said first rope-like configuration;

i. fastening said first and second rope-like sections together;

j. releasing the first roped section from said turntable clamp; and k. severing the material from the roll of stretchable material allowing the fastened roped sections to move toward the load and complete the package wrap.

11. A process of making a spiral wrapped unitary package as claimed in claim 10 wherein said fastening step comprises tying said first and second rope-like configurations together with a piece of material substantially surrounding said configurations.

12. The process as claimed in claim 10 wherein the roped web held in the clamp mounted to the turntable of step (b) is rotated at least one-quarter revolution and the tension in step (d) applied to the stretchable material is substantially one hundred percent of the tension setting used during the wrap cycle.

13. The process of making a spiral wrapped unitary package as claimed in claim 10 wherein the tension on the film web is reduced when the material web is formed into the second rope-like configuration of step (g), and the first and second rope-like sections of step (f) are fastened together by placing a clamp member around the two roped sections.

14. The process of making a spiral wrapped unitary load as claimed in claim 10, wherein the release of the first roped section in step (j) is accomplished by opening the clamp to release the former leading end allowing the fastened end to move to a memory position between the load and a cutting device, and including a following step of reclamping the second rope-like configuration on the trailing roped end of the film web.

15. A process for spirally wrapping a web of stretched material on a load comprising a plurality of units to form a unitized package comprising:

a. closing the web to a reduced width;

b. wrapping the closed web width around at least a portion of the load;

c. opening the web width from its closed position while continuing the wrapping of the load;
d. wrapping the web reciprocally relative the load to form a plurality of spiral wraps around the load;
e. closing the web to a reduced width near the end of the wrap;
f. completing the wrapping of the web around the load;
g. engaging the trailing closed web width at the end of the wrap with a mechanism to position the trailing closed web width adjacent the leading closed web width;
h. fastening the leading closed web width of the wrap to the trailing closed web width of the wrap; and
i. severing said material web between the material roll and the fastened roped web sections.

16. An apparatus for making a package comprising a frame, a carriage moveably mounted on said frame, said carriage being adapted to hold a roll of stretchable material for rotation, a turntable adapted to support a load positioned adjacent said frame, drive means connected to said turntable and adapted to rotate said turntable and an associated load mounted on said turntable to cause a web of stretchable material to be pulled from a roll of material held by said carriage to overwrap said load, stretching means connected to said carriage, said stretching means being adapted to restrict movement of the web of material from said roll so that said material is stretched as it is transferred to said load, means to drive said carriage reciprocally along said frame so that a plurality of overlapping layers of material are placed on said load to form a wrap, said carriage being driven along the frame in one direction to provide a wrap for a load and returning in an opposite direction while continuing to wrap the load, roper means mounted adjacent the material path, said roper means engaging said material web to form said film web into a rope-like configuration having a width less than the width of the original web clamp means to clamp said roped material web and hold said web in a fixed position while stretched material is wrapped around said load, a moveable assembly mounted to said frame, means for moving said moveable assembly to carry a roped configured web adjacent said roped material web held in said clamp means, said apparatus including fastening means comprising a mechanism for placing a tie around said adjacent roped material webs to hold them together and cutting means for severing said material web from said material roll dispenser.

17. An apparatus as claimed in claim 16 wherein said roper means comprises a rectangular frame and piston means connected to said apparatus frame adapted to transport said rectangular frame in a 90° arc.

18. An apparatus as claimed in claim 16 wherein said brake means comprises a roller assembly and a particle brake operatively connected to said roller assembly causing said roller assembly to apply restrictive force on the exterior of said netting roll to uniformly stretch said material.

19. An apparatus as claimed in claim 16 wherein said stretched material is a plastic netting.

20. An apparatus as claimed in claim 16 wherein said fastening means comprises a standard hog ringer assembly positioned for movement adjacent to said film web path.

21. An apparatus as claimed in claim 16 wherein said cutting means comprises a slidable knife assembly mounted to said fastening means, said knife assembly comprising a cutting housing defining a tapering notch therein adapted to guide the material web into an area for cutting and a slidable knife reciprocally mounted in said cutting housing, said knife being activated by piston means which drives said knife through said cutting notch to sever material held within said cutting notch.

22. An apparatus for making a unitary package comprising a vertical frame, a carriage moveably mounted on said frame, a roll of stretchable material rotatably mounted on said carriage, film stretching means connected to said carriage to restrict the material being dispensed from the material roll stretching the same, a turntable adapted to support a load positioned adjacent to said frame, drive means connected to said turntable and adapted to rotate said turntable and an associated load placed on said turntable causing stretched material from said roll of material held by said carriage to overwrap said load, means for reciprocally moving said carriage to provide plural spiral wraps on said load, means to convolute said material positioned adjacent said frame, means for moving said convoluting means so that it will receive the width of said material and form it into a convoluted configuration having a width less than fifty percent of the width of the stretched material dispensed from the material roll at the beginning and at the end of the wrapping operation, film clamp means mounted to said turntable, said film clamp means being adapted to clamp convoluted material, a moveable arm assembly with cutting and tying means mounted thereon mounted downstream from said convoluting means to selectively engage convoluted material and hold convoluted material adjacent to convoluted material held in said turntable clamp means, said tying means having means to tie said adjacent convoluted materials together with a tie member, said cutting means severing said tied materials from said material roll.

23. An apparatus as claimed in claim 22 wherein said clamp means comprises a fixed member mounted to said turntable, a rotary pneumatic cylinder mounted to said fixed member and a rotatable clamp assembly mounted to said rotatable cylinder and adapted to be rotatably driven by said cylinder to engage said fixed member in a clamping position.

24. An apparatus as claimed in claim 23 wherein said rotatable clamp assembly comprises a first member mounted on one side of said fixed member and a second member connected to said first member and spaced therefrom by a spacing member, said second member defining an aperture therein through which said pneumatic cylinder extends so that said rotatable clamp assembly can rotate around said cylinder, said second member defining a notch adapted to direct convoluted material into said clamping area.

25. An apparatus as claimed in claim 24 including a frictional clamp means mounted to said fixed member, said frictional clamp means comprising a "U" shaped seat and resilient member mounted in said seat.

26. An apparatus as claimed in claim 22 wherein said means to tie comprises to engage a material clip around said leading and trailing material ends and hold said leading and trailing material ends in a fixed position, and cutting means adapted to sever said material between said tied area and said material roll.

* * * * *